US012808012B2

(12) United States Patent
Seo et al.

(10) Patent No.: US 12,808,012 B2
(45) **Date of Patent: *Nov. 24, 2026**

(54) HIGH-STRENGTH COLD-ROLLED STEEL SHEET HAVING EXCELLENT SURFACE QUALITY AND LOW MATERIAL VARIATION, AND METHOD FOR MANUFACTURING SAME

(71) Applicant: POSCO CO., LTD, Pohang-si (KR)

(72) Inventors: Chang-Hyo Seo, Gwangyang-si (KR); Sung-Il Kim, Gwangyang-si (KR); Joo-Hyun Ryu, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/693,983

(22) PCT Filed: Sep. 20, 2022

(86) PCT No.: PCT/KR2022/014023

§ 371 (c)(1),
(2) Date: Mar. 21, 2024

(87) PCT Pub. No.: WO2023/048450

PCT Pub. Date: Mar. 30, 2023

(65) Prior Publication Data

US 2024/0384366 A1 Nov. 21, 2024

(30) Foreign Application Priority Data

Sep. 24, 2021 (KR) ..... 10-2021-0126117

(51) Int. Cl.

| | |
|---|---|
| ***C21D 9/46*** | (2006.01) |
| ***C21D 1/18*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/32*** | (2006.01) |
| ***C22C 38/34*** | (2006.01) |
| ***C22C 38/38*** | (2006.01) |

(52) U.S. Cl.

CPC ..... *C21D 9/46* (2013.01); *C21D 1/18* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/32* (2013.01); *C22C 38/34* (2013.01); *C22C 38/38* (2013.01); *C21D 2211/001* (2013.01); *C21D 2211/002* (2013.01); *C21D 2211/008* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 2004/0261919 | A1 | 12/2004 | Nakajima et al. | |
| 2014/0246128 | A1 | 9/2014 | Takashima et al. | |
| 2015/0299834 | A1 | 10/2015 | Mizuta et al. | |
| 2017/0137906 | A1 | 5/2017 | Fan et al. | |
| 2017/0183753 | A1 | 6/2017 | Pipard et al. | |
| 2017/0260602 | A1 | 9/2017 | An et al. | |
| 2018/0171442 | A1 | 6/2018 | Tsunezawa et al. | |
| 2020/0232073 | A1 | 7/2020 | Yang et al. | |
| 2021/0164077 | A1 | 6/2021 | Kim et al. | |
| 2022/0056564 | A1 | 2/2022 | Kang et al. | |
| 2022/0064750 | A1 | 3/2022 | Na et al. | |
| 2022/0259691 | A1 | 8/2022 | Im et al. | |
| 2022/0349019 | A1 | 11/2022 | Im et al. | |
| 2023/0098505 | A1 | 3/2023 | Li et al. | |
| 2024/0392407 | A1* | 11/2024 | Kim | C21D 8/0273 |

FOREIGN PATENT DOCUMENTS

| | | | |
|---|---|---|---|
| CN | 109207867 | A | 1/2019 |
| CN | 113136528 | A | 7/2021 |
| CN | 113195771 | A | 7/2021 |
| EP | 2258887 | A1 | 12/2010 |

(Continued)

OTHER PUBLICATIONS

English machine translation of JP 2013-163827 A of Azuma (Year: 2013).*

International Search Report—PCT/KR2022/014023 dated Dec. 13, 2022.

Japanese Office Action—Japanese Application No. 2024-518482 issued on May 7, 2025, citing JP 2021-025094, JP 2007-197819, JP H06-145891, JP 2013-221198, JP 2013-076117, WO 2016/021197, JP 2006-307281, JP 2022-515159, JP S62-161935, CN 113136528, and CN 109207867.

European Search Report—European Application No. 22873155.0 issued on Oct. 10, 2025, citing EP 3 859 041 A1, US 2015/0299834 A1, WO 2021/020789 A1, WO 2021/020787 A1, EP 2 258 887 A1, and EP 3 686 293 A1.

(Continued)

*Primary Examiner* — Jophy S. Koshy

(74) *Attorney, Agent, or Firm* — CANTOR COLBURN LLP

(57) ABSTRACT

Provided is a high-strength cold-rolled steel sheet having excellent surface quality and low material variation, and a method for manufacturing same. More specifically, the present invention pertains to: a high-strength cold-rolled steel sheet which has few surface defects and little material deviation, as well as high strength and elongation, and is thus suitable for use in automotive parts; and a method for manufacturing same.

9 Claims, 1 Drawing Sheet

(56) References Cited

FOREIGN PATENT DOCUMENTS

| | | | |
|---|---|---|---|
| EP | 3686293 | A1 | 7/2020 |
| EP | 3859041 | A1 | 8/2021 |
| JP | S62161935 | A | 7/1987 |
| JP | H06145891 | A | 5/1994 |
| JP | 2006307281 | A | 11/2006 |
| JP | 2007197819 | A | 8/2007 |
| JP | 2010090432 | A | 4/2010 |
| JP | 2013076117 | A | 4/2013 |
| JP | 2013103235 | A | 5/2013 |
| JP | 2013163827 | A | 8/2013 |
| JP | 2013221198 | A | 10/2013 |
| JP | 2021025094 | A | 2/2021 |
| JP | 2022515159 | A | 2/2022 |
| KR | 20040066935 | A | 7/2004 |
| KR | 20160024681 | A | 3/2016 |
| KR | 20170015303 | A | 2/2017 |
| KR | 20170015998 | A | 2/2017 |
| KR | 101726130 | B1 | 4/2017 |
| KR | 20190076765 | A | 7/2019 |
| KR | 20190110580 | A | 9/2019 |
| WO | 2016021197 | A1 | 2/2016 |
| WO | 2021020787 | A1 | 2/2021 |
| WO | 2021020789 | A1 | 2/2021 |

OTHER PUBLICATIONS

Chinese Office Action—Chinese Application No. 202280062753.8 issued on Apr. 23, 2026, citing JP 2013-1638271 JP 2013-103235 A, KR 10-2019-0076765 A, and CN 113195771 A.

* cited by examiner

HIGH-STRENGTH COLD-ROLLED STEEL SHEET HAVING EXCELLENT SURFACE QUALITY AND LOW MATERIAL VARIATION, AND METHOD FOR MANUFACTURING SAME

TECHNICAL FIELD

The present invention pertains to a high-strength cold-rolled steel sheet used in structural members with a large amount of forming, such as pillars, seat rails, members, and the like, of a vehicle body and a method for manufacturing the same, and more particularly to a high-strength cold-rolled steel sheet that has excellent surface quality and low material deviation and can be suitably used for automotive parts and a method for manufacturing the same.

BACKGROUND ART

In recent years, as safety and environmental regulations are being strengthened in the automobile industry, the use of high-strength steel with a tensile strength of 1180 MPa or more is increasing when manufacturing vehicle bodies to improve vehicle fuel efficiency and protect passengers.

High-strength steel used in conventional vehicle bodies includes a dual phase (DP) steel, comprising dual phases, which are a soft ferrite matrix and hard martensite phase, a transformation induced plasticity (TRIP) steel using transformation-induced plasticity of retained austenite, a complex phase (CP) steel, comprising a complex structure of ferrite and hard bainite or martensite, or the like.

However, in high-strength steel, when a large amount of Si, Al, Mn, or the like are added, there may be a problem in that weldability is poor and surface defects of the steel sheet occur due to dents in a furnace during annealing. In addition, when a large amount of hardenable elements such as Mn, Cr, Mo, or the like are added, there may be a problem in that material deviation of a hot-rolled coil occurs, so that thickness quality may deteriorate during cold rolling. In this case, the surface defects due to dents of the steel sheet in a furnace refer to surface defects of the steel sheet formed when metal-based oxides on a surface of the steel sheet are adsorbed and accumulated on rolls of an annealing furnace, and by contact between the steel sheet and the rolls during rolling.

The contents of the prior art related to manufacturing technology of high-strength cold-rolled steel sheets and hot-dip galvanized steel sheets to solve the above-described problems are briefly described as follows.

Among the prior art, Patent Document 1 discloses a high-strength cold-rolled steel sheet and a method for manufacturing the same, through a process of cold rolling a hot-rolled steel sheet including a low-temperature transformation phase of 60% or more, by volume, at a cold rolling reduction rate of more than 60% and less than 80%, and a process of continuously annealing a steel sheet after cold rolling in a ferrite and austenite dual-phase zone. However, the cold-rolled steel sheet obtained from Patent Document 1 had a strength as low as 370 to 590 MPa, causing a problem in that it is difficult to be applied to vehicle impact-resistant members and limited to use only for interior and exterior panels.

In addition, Patent Document 2 discloses a method for manufacturing a cold-rolled steel sheet simultaneously obtaining high strength and high ductility by utilizing a tempered martensite phase, and having an excellent plate shape after continuous annealing. However, the technology of Patent Document 2 had a problem of poor weldability due to a high carbon content in steel, which is 0.2% or more, and a problem of the occurrence of surface defects due to dents in the furnace due to a large amount of Si contained therein.

(Patent Document 1) Korean Patent Publication No. 2004-0066935

(Patent Document 2) Japanese Patent Publication No. 2010-090432

SUMMARY OF INVENTION

Technical Problem

An aspect of the present disclosure is to provide a high-strength cold-rolled steel sheet having excellent surface quality and low material deviation and a method for manufacturing the same.

An object of the present disclosure is not limited to the above description. The object of the present disclosure will be understood from the entire content of the present specification, and a person skilled in the art to which the present disclosure pertains will understand additional objects of the present disclosure without difficulty.

Solution to Problem

According to an aspect of the present disclosure, provided is a high-strength cold-rolled steel sheet, the high-strength cold-rolled steel sheet including: by weight %, C: 0.05 to 0.3%, Si: 0.01 to 2.0%, Mn: 1.5 to 3.0%, Al: 0.01 to 0.1%, P: 0.001 to 0.015%, S: 0.001 to 0.01%, N: 0.001 to 0.01%, with a remainder of Fe, and other unavoidable impurities, wherein a value defined by Relational Expression 1 satisfies 1.2 or more and 1.5 or less, as a microstructure, by area %, a sum of bainite and martensite: 90% or more, and a remainder including austenite, wherein an average number of surface defects satisfying one or more conditions of a depth of 100 μm or more and a short side length of 1 mm or more, is less than $10/m^2$.

[Relational Expression 1]

$$C + (1.3 \times Si + Mn)/6 + (Cr + 1.2 \times Mo)/5 + 100 \times B$$

In Relational Expression 1, C, Si, Mn, Cr, Mo, and B represent an average weight percent percentage for each element. In addition, when each of the above-described elements is not added, 0 is substituted.

According to another aspect of the present disclosure, provided is a method for manufacturing a high-strength cold-rolled steel sheet, the method for manufacturing a high-strength cold-rolled steel sheet including: reheating a steel slab including, by weight %, C: 0.05 to 0.3%, Si: 0.01 to 2.0%, Mn: 1.5 to 3.0%, Al: 0.01 to 0.1%, P: 0.001 to 0.015%, S: 0.001 to 0.01%, N: 0.001 to 0.01%, with a remainder of Fe and other unavoidable impurities, wherein a value defined by Relational Expression 1 satisfies 1.2 or more and 1.5 or less, to a temperature within a range of 1100 to 1350° C.;

hot rolling the reheated steel slab at a temperature within a range of 850 to 1150° C.;

cooling the hot-rolled steel sheet to a temperature within a range of 450 to 700° C. at an average cooling rate of 10 to 70° C./s;

coiling the cooled steel sheet at a temperature within a range of 450 to 700° C.;

cold rolling the wound steel sheet at a reduction rate of 40 to 70%; and continuously annealing the cold-rolled steel sheet at a temperature within a range of 740 to 900° C., wherein in the coiling, based on a entire width of the steel sheet, a surface temperature (Te) of both end portions in a width direction is controlled to satisfy a temperature within a range of 601 to 700° C., and a surface temperature (Tc) of a center portion is controlled to satisfy a temperature within a range of 450 to 600° C.

[Relational Expression 1]

$$C + (1.3 \times Si + Mn)/6 + (Cr + 1.2 \times Mo)/5 + 100 \times B$$

In Relational Expression 1, C, Si, Mn, Cr, Mo, and B represent an average weight percentage of each element. In addition, if each of the above-described elements is not added, 0 is substituted.

Advantageous Effects of Invention

According to an aspect of the present disclosure, a high-strength cold-rolled steel sheet having excellent surface quality and low material deviation, and a method for manufacturing the same may be provided.

Various and beneficial advantages and effects of the present disclosure are not limited to the above-described content, and may be more easily understood through description of specific embodiments of the present disclosure.

BEST MODE FOR INVENTION

Figure 1:
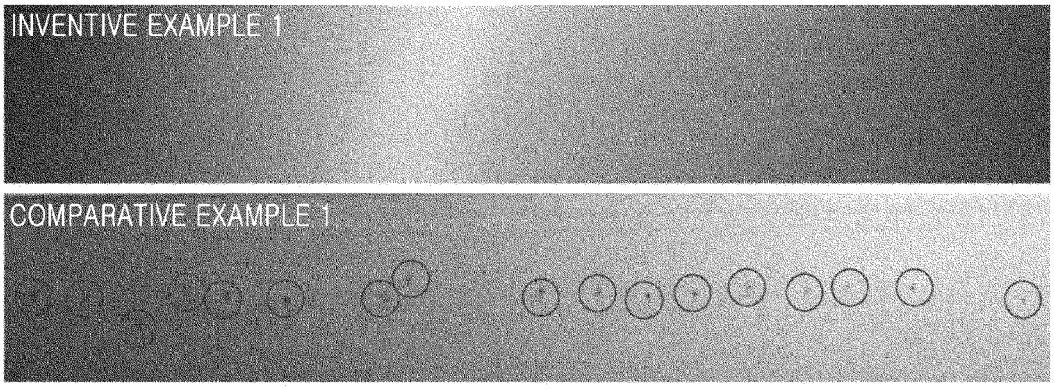
FIG. 1 illustrates an image captured with a general low-magnification camera of surface defects of each cold-rolled steel sheet obtained from Inventive Example 1 and Comparative Example 1 of the present disclosure.

Hereinafter, preferred embodiments of the present disclosure will be described. However, the embodiments of the present disclosure can be modified into various other forms, and the scope of the present disclosure is not limited to the embodiments described below. In addition, the embodiments of the present disclosure are provided to more completely explain the present disclosure to those with average knowledge in the related technical literature.

Meanwhile, the terms used herein are intended to describe the present disclosure and are not intended to limit the present disclosure. For example, the singular forms used herein include the plural forms unless the related definition clearly dictates the contrary. In addition, the meaning of "comprising" as used in the specification specifies a component, and does not exclude the presence or addition of other components.

In the prior art, a technology has not been developed, to satisfy advanced demands for a cold-rolled steel sheet having a high strength of 1180 MPa or more and excellent formability, and that can be applied to structural members with a large amount of forming, and having excellent surface quality and low material deviation.

Accordingly, the present inventors conducted in-depth studies to provide a cold-rolled steel sheet satisfying all of the above-described characteristics, while solving the problems in the prior art, and as a result thereof, the present inventors have confirmed that the above-described object could be achieved by optimizing the composition and manufacturing conditions of the steel sheet, and controlling the characteristics of microstructure and surface defects, and thus the present disclosure was provided.

That is, according to the present disclosure, it is possible to effectively provide a high-strength steel material having a high strength of 1180 MPa or more, having a product of tensile strength and elongation of 15,000 MPa % or more (more preferably, 16,000 MPa % or more) which is high, as a microstructure includes austenite, and that can be suitably applied to highly formed parts such as B-pillars.

Hereinafter, a high-strength steel sheet having excellent surface quality and low material variation according to an aspect of the present disclosure will be described in detail.

According to an aspect of the present disclosure, a high-strength cold-rolled steel sheet includes, by weight %, C: 0.05 to 0.3%, Si: 0.01 to 2.0%, Mn: 1.5 to 3.0%, Al: 0.01 to 0.1%, P: 0.001 to 0.015%, S: 0.001 to 0.01%, N: 0.001 to 0.01%, with a remainder of Fe, and other unavoidable impurities.

Hereinafter, the reason for which the components of the cold-rolled steel sheet are added and the content thereof provided in the present disclosure is limited will be described in detail. In this case, in the present specification, when indicating the content of each element, unless otherwise particularly stated in the present disclosure, the content of each element is by weight %.

Carbon (C): 0.05 to 0.3%

Carbon (C) is a very important element in securing a martensite structure, effective in strengthening steel. When an amount of C added increases, a fraction of a martensite phase and bainite phase increases, resulting in an increase in tensile strength. Therefore, to ensure high strength, a lower limit of the C content is controlled to be 0.05%. However, when the C content increases, an austenite region expands during dual-phase zone annealing, so the fraction of the martensite phase and bainite phase, which are hard phases, increases, and a fraction of an austenite phase, which is a soft phase, decreases, resulting in inferior formability and inferior weldability. Therefore, an upper limit of the C content is controlled to be 0.3%. Meanwhile, in terms of further improving the above-described effect, more preferably, the lower limit of the C content may be 0.10%, or the upper limit of the C content may be 0.20%.

Silicon (Si): 0.01 to 2.0%

Silicon (Si) is an element, deoxidizing molten steel and having a solid-solution strengthening effect, which is advantageous for improving formability by delaying formation of coarse carbides. However, when the Si content is less than 0.01%, the above-described effect is low, making it difficult to improve formability. On the other hand, when the Si content exceeds 2.0%, red scales due to Si is severely formed on a surface of the steel sheet during hot rolling, and surface thickening occurs during an annealing process, so that non-plating occurs. In addition, plating adhesion becomes poor due to the formation of surface oxides, so there is a problem in that the surface quality becomes very poor. Therefore, in the present disclosure, a Si content is controlled to be 0.01 to 2.0%. Meanwhile, in terms of further improving the above-described effect, more preferably, a lower limit of the Si content may be 0.3%, or an upper limit of the Si content may be 1.90%.

Manganese (Mn): 1.5 to 3.0%

Manganese (Mn), like Si, is an element, which is effective in solid-solution strengthening steel, and is an element greatly increasing hardenability. However, when a Mn content is less than 1.5%, the above-described effects due to addition cannot be obtained, and when the Mn content exceeds 3.0%, the strengthening effect greatly increases and ductility decreases. In addition, during slab casting in a continuous casting process, a segregated portion develops significantly in a thickness center portion, and during cooling after hot rolling, a microstructure thereof in a thickness direction becomes non-uniform and MnS is formed, resulting in poor formability such as stretch flangeability, or the like. Therefore, in the present disclosure, the Mn content is controlled to be 1.5 to 3.0%. Meanwhile, in terms of further improving the above-described effect, more preferably, a lower limit of the Mn content may be 2.0%, or an upper limit of the Mn content may be 2.8%.

Aluminum (Al): 0.01 to 0.1%

Aluminum (Al) is a component, mainly added for deoxidation. When the Al content is less than 0.01%, an addition effect thereof is insufficient. On the other hand, when the Al content exceeds 0.1%, AlN is formed by combining with nitrogen, so it is likely to cause corner cracks in the slab during continuous casting, and it is likely to cause defects due to inclusion formation. Therefore, in the present disclosure, the Al content is controlled to be 0.01 to 0.1%. Meanwhile, in terms of further improving the above-described effect, more preferably, a lower limit of the Al content may be 0.015%, or an upper limit of the Al content may be 0.06%.

Phosphorus (P): 0.001 to 0.015%

Phosphorus (P) is an alloy element having a significant solid-solution strengthening effect and may have a characteristic that can achieve a significant solid-solution strengthening effect even with a small content of P. However, if P is added excessively, brittleness may occur due to grain boundary segregation, microcracks are likely to occur during forming, and ductility and impact resistance are greatly deteriorated. In addition, there may be a problem of causing defects on a surface thereof during plating. Therefore, an upper limit of a P content is controlled to be 0.015%. Meanwhile, if the P content is less than 0.001%, excessive manufacturing costs may be required to satisfy the P content, which is not only economically disadvantageous, but also the secured strength becomes insufficient, so a lower limit of the P content is controlled to be 0.001% or more. Therefore, in the present disclosure, it is preferable to control the P content to be 0.001 to 0.015%. Meanwhile, in terms of further improving the above-mentioned effect, more preferably, the lower limit of the P content may be 0.003%, or an upper limit of the P content may be 0.012%.

Sulfur(S): 0.001 to 0.01%

Sulfur(S) is an impurity present in steel. When a S content exceeds 0.01%, S combines with Mn to form non-metallic inclusions, and as a result, there is a problem in that fine cracks are likely to occur during cutting and processing of steel, and extension flangeability and impact resistance are greatly deteriorated. In addition, in order to form the S content to be less than 0.001%, there is a problem in that a large amount of time is required during steelmaking operation, which reduces productivity. Therefore, in the present disclosure, it is preferable to control the S content to be 0.001 to 0.01%. Meanwhile, in terms of further improving the above-described effect, more preferably, a lower limit of the S content may be 0.002%, or an upper limit of the S content may be 0.005%.

Nitrogen (N): 0.001 to 0.01%

Nitrogen (N) is a representative solid-solution strengthening element along with C, and contributes to forming coarse precipitates along with Ti and Al. In general, a solid-solution strengthening effect of N is better than that of carbon, but there is a problem in that the toughness decreases significantly as an amount of N in steel increases. In addition, in order to form a N content to be less than 0.001%, there is a problem that productivity is reduced because a large amount of time is required during steelmaking operation. Therefore, in the present disclosure, it is preferable to control the N content to be 0.001 to 0.01%. Meanwhile, in terms of further improving the above-described effect, more preferably, a lower limit of the N content may be 0.002%, and an upper limit of the N content may be 0.006%.

Meanwhile, according to an aspect of the present disclosure, although not particularly limited, optionally, the cold-rolled steel sheet may include, by weight %, one or more elements selected from Cr: 1.0% or less (including 0%), Mo: 0.2% or less (including 0%), and B: 0.005% or less (including 0%). Hereinafter, the reason for which the selected elements are added and the content thereof provided in the present disclosure is limited will be described in detail.

Chromium (Cr): 1.0% or Less (Including 0%)

Chromium (Cr) is a component added to improve hardenability of steel and ensure high strength, and is an element that plays a very important role in formation of martensite, which is also advantageous for manufacturing composite steel with high ductility by minimizing a decrease in elongation compared to an increase in strength. Therefore, Cr may be selectively added for the above-described effect. However, if the Cr content exceeds 1.0%, not only are the above-described effects saturated, but there is a problem in that cold rolling properties are deteriorated due to an excessive increase in hot rolling strength. In addition, since there is a problem that a fraction of martensite increases significantly after annealing, resulting in a decrease in elongation, an upper limit of the Cr content is controlled to be 1.0% or less. Meanwhile, in terms of further improving the above-described effect, more preferably, a lower limit of the Cr content may be 0.1%, or an upper limit of the Cr content may be 0.8%.

Molybdenum (Mo): 0.2% or Less (Including 0%)

Molybdenum (Mo) is an element that suppresses pearlite formation and increases hardenability. Therefore, in order to secure the above-described effects, Mo may be selectively added in the present disclosure. However, if a Mo content exceeds 0.2%, an effect of improving strength may not increase significantly, but ductility may deteriorate, which may be economically disadvantageous. Therefore, it is preferable to control the Mo content to be 0.2% or less. Meanwhile, in terms of further improving the above-described effect, more preferably, a lower limit of the Mo content may be 0.01%, or an upper limit of the Mo content may be 0.20%.

Boron (B): 0.005% or Less (Including 0%)

When boron (B) exists in a solid state in steel, B has an effect of improving brittleness of steel in a low-temperature zone by stabilizing grain boundaries, and greatly increases hardenability of steel. Therefore, B can be selectively added for the above-described effect. However, if an upper limit of the B content exceeds 0.005%, recrystallization is delayed during annealing and oxides are formed on a surface thereof, resulting in poor plating properties. Therefore, it is preferable to control the B content to be 0.005% or less. Meanwhile, in terms of further improving the above-mentioned effect, more preferably, a lower limit of the B content may be 0.0015%, or an upper limit of the B content may be 0.0025%.

The remaining component of the present disclosure is iron (Fe). However, since in the common manufacturing process, unintended impurities may be inevitably incorporated from raw materials or the surrounding environment, the component may not be excluded. Since these impurities are known to any person skilled in the common steelmaking manufacturing process, the entire contents thereof are not particularly mentioned in the present specification.

According to an aspect of the present disclosure, the high-strength cold-rolled steel sheet may have a value defined by Relational Expression 1 of 1.2 or more and 1.5 or less. By satisfying this value, the high-strength cold-rolled steel sheet may have a product of tensile strength and elongation of 15,000 MPa % or more (more preferably, 16,000 MPa % or more and 20,000 MPa % or less, most preferably, 16,300 MPa % or more and 18,000 MPa % or less), so that the steel sheet may be suitably used to highly formed parts, and a desired material thereof may be secured by minimizing material deviation of the cold-rolled steel sheet and suppressing the occurrence of surface defects.

[Relational Expression 1]

$$C + (1.3 \times Si + Mn)/6 + (Cr + 1.2 \times Mo)/5 + 100 \times B$$

In Relational Expression 1, C, Si, Mn, Cr, Mo, and B represent an average weight percentage for each element. In this case, when each of the above-described elements is not added, 0 is substituted.

In the present disclosure, Relational Expression 1 is an expression representing hardenability of a steel material according to the composition of the present disclosure, and a coefficient before each element quantitatively represents a scale by which the element contributes to hardenability. If the hardenability of the steel material is high, it is advantageous to secure a hard low-temperature transformation phase such as a bainite phase and a martensite phase, which contributes to improving strength. The lower the hardenability is, austenite transformation is promoted, which is disadvantageous in securing strength.

In particular, in order to secure a high strength of 1180 MPa or more, which is a target tensile strength in the present disclosure, and satisfy high formability, wherein a product of tensile strength and elongation is 15,000 MPa % or more (more preferably 16,000 MPa % or more and 20,000 MPa % or less, most preferably 16,300 MPa % or more and 18,000 MPa), a value defined from Relational Expression 1 should satisfy 1.2 or more. However, if the value defined from Relational Expression 1 exceeds 1.5, the strength becomes too high, so there is a problem in that elongation deteriorates. In addition, if the value defined from Relational Expression 1 exceeds 1.5, phase transformation of austenite is significantly delayed in an operation of cooling a hot-rolled steel sheet, immediately after hot rolling, to a temperature within a range of 450 to 700° C. at an average cooling rate of 10 to 70° C./s. As a result, in a subsequent coiling operation, among bainite phases in the hot-rolled steel sheet, lower bainite and martensite phases having high hardness are excessively formed, causing material deviation depending on a position thereof in a width direction to deteriorate and a shape thereof to deteriorate. Therefore, in the present disclosure, it is preferable to control the value defined by Relational Expression 1 to satisfy 1.2 or more and 1.5 or less.

In terms of maximizing the above-described effect, a lower limit of the value defined by Relational Expression 1 may be 1.21, or an upper limit of the value defined by Relational Expression 1 may be 1.48.

Meanwhile, according to an aspect of the present disclosure, the high-strength cold-rolled steel sheet includes: by area, as a microstructure, a sum of bainite and martensite: 90% or more, and a remainder includes austenite.

In the microstructure, if the sum of bainite and martensite is less than 90%, there is a problem of insufficient strength. In addition, the remainder may be austenite, and in the microstructure, austenite may be 10% or less (excluding 0%) by area percent. In the microstructure, if austenite exceeds 10%, there is a problem of insufficient elongation.

According to an aspect of the present disclosure, the high-strength cold-rolled steel sheet may include: by area, as a microstructure, a sum of bainite and martensite: 90% or more (excluding 100%), and a remainder of austenite (i.e., austenite: 10% or less (excluding 0%)). Alternatively, in terms of further improving the above-described effect, an upper limit of the sum of bainite and martensite may be 97%.

Alternatively, according to an aspect of the present disclosure, although not particularly limited, in terms of improving tensile strength and elongation, the microstructure may include, by area %, austenite: 3 to 4%. In the microstructure, if austenite is less than 3%, a problem of insufficient elongation may occur, and if austenite exceeds 4%, a problem of insufficient strength may occur.

Alternatively, according to an aspect of the present disclosure, although not particularly limited, the microstructure may include, by area: bainite: 78 to 86%. In the microstructure, if bainite is less than 78%, or bainite exceeds 86%, a strength may be insufficient, and it may be difficult to secure a cold-rolled steel sheet having a product of tensile strength and elongation of 15,000 MPa % or more.

Alternatively, according to an aspect of the present disclosure, although not particularly limited, the microstructure may include, by area: martensite: 11 to 18%. In the microstructure, if martensite is less than 11%, the strength may be insufficient, and if martensite exceeds 18%, which may cause a problem in that it may be difficult to secure a cold-rolled steel sheet having a product of tensile strength and elongation of 15,000 MPa % or more.

According to an aspect of the present disclosure, in the high-strength cold-rolled steel sheet, an average number of surface defects satisfying one or more conditions of a depth of 100 μm or more and a short side length of 1 mm or more is less than $10/m^2$ (including $0/m^2$). In measuring the average number of surface defects, the conditions that the 'depth is 100 μm or more' or 'short side length is 1 mm or more' are merely sufficient determination criteria as long as they are satisfied to measure the average number of surface defects. Therefore, in this specification, an upper limit value for each of the depth and short side length described above is not particularly limited.

Figure 2:
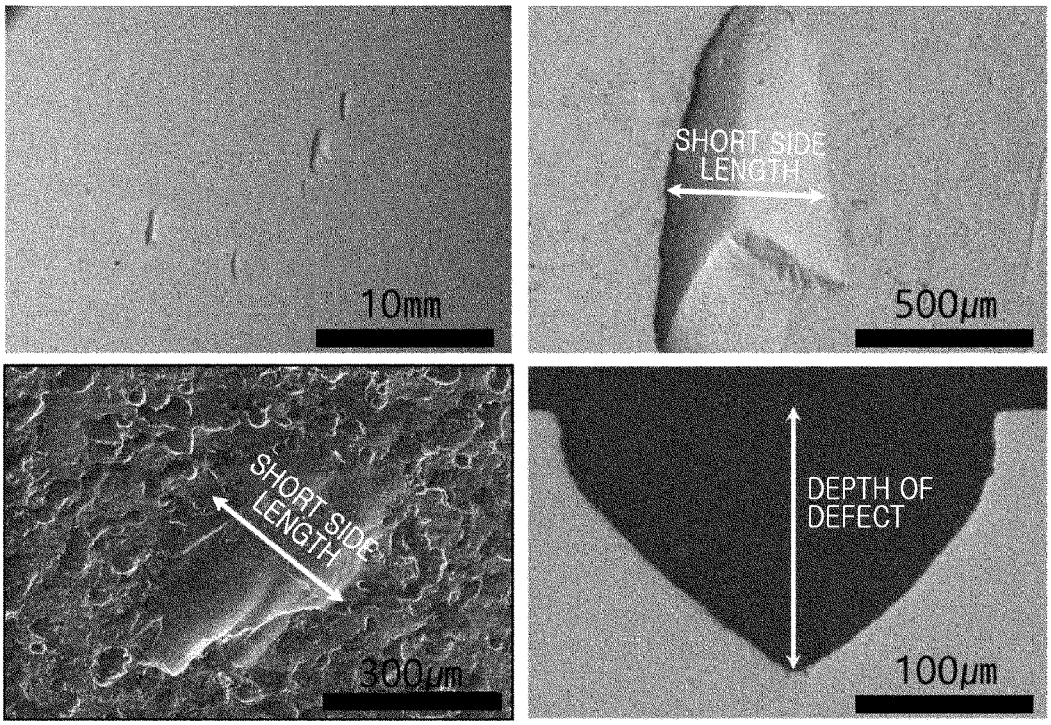
FIG. 2 illustrates an image captured with a high-magnification scanning cell microscope (SEM) of the surface defects defined in the present disclosure.

In the present disclosure, a surface defect refers to a defect having a groove shape, and specifically, a defect in a form of a dent in a thickness direction, which is a defect that can be confirmed when observing the surface of the steel sheet with a naked eye. In addition, the depth of the surface defect may mean a maximum depth' in the thickness direction for the defect having the groove shape, based on a cross-section of the cold-rolled steel sheet in the thickness direction (i.e., a direction perpendicular to a rolling direction, based on the cross-section). In addition, the short side length of the surface defect may mean a shortest length passing through a point of the maximum depth, based on the surface of the cold-rolled steel sheet. Meanwhile, in order to observe the surface defect having the groove shape existing on the surface of the above-described steel sheet and confirm the depth and short side length of each surface defect, an image captured using a high-magnification scanning electron microscope (SEM) is shown in FIG. 2.

The present inventors have repeatedly conducted extensive research to solve the problems in the prior art, and to provide a cold-rolled steel sheet that can minimize surface defects and material deviation while securing a desired level of strength and formability.

As a result thereof, the present inventors have found that the above-described effects may be secured, by controlling the average number of surface defects satisfying one or more of the above-described depth of 100 μm or more and short side length of 1 mm or more to be less than $10/m^2$. That is, in the present disclosure, if the average number of surface defects is $10/m^2$ or more, a problem of surface dents may occur. Meanwhile, in terms of further improving the above-described effect, preferably, the average number of surface defects described above may be $8/m^2$ or less.

Meanwhile, according to an aspect of the present disclosure, the present inventors have repeatedly conducted additional research to provide a cold-rolled steel sheet that can simultaneously secure the desired level of strength and formability without affecting material deviation, or the like, even if there are surface defects on the surface of the steel sheet.

As a result thereof, in the present disclosure, the present inventors have additionally found that surface defect characteristics at a level, without affecting material deviation, or the like, even if surface defects exist. Specifically, although not particularly limited in the present disclosure, a maximum depth of the surface defects may be 500 μm or less. In this case, the maximum depth of the surface defects may mean a maximum value of the depth for each surface defect existing on the surface of the steel sheet.

Meanwhile, according to an aspect of the present disclosure, a difference in yield strength (YS) between both end portions and a center portion in a width direction of the cold-rolled steel sheet may be 100 MPa or less. By satisfying the difference in the yield strength between both end portions and the center portion to be 100 MPa or less, a steel sheet having reduced material deviation in the width direction may be provided, and a material thereof may be uniform in the width direction. In this case, the 'both end portions' may refer to sections, corresponding to 30% (corresponding to a sum of: 60%) from both ends based on a total width (referred to as 100%) of the cold-rolled steel sheet in a width direction thereof, and the 'center portion' may refer to a section, corresponding to 40% excluding the both end portions, based on the total width of the cold-rolled steel sheet in the width direction thereof.

According to an aspect of the present disclosure, the cold-rolled steel sheet may have a tensile strength of 1180 MPa or more, and more preferably 1200 MPa or more and 1310 MPa or less. If the tensile strength of the cold-rolled steel sheet is less than 1200 MPa, there may be a problem in that the strength required for highly formed parts, may not be achieved, and if the tensile strength of the cold-rolled steel sheet exceeds 1310 MPa, there may be a problem in that the steel sheet may not be applied appropriately to highly formed parts, due to inferior elongation.

In addition, according to an aspect of the present disclosure, the cold-rolled steel sheet may have a yield strength (YS) of 870 MPa or more, and more preferably 870 MPa or more and 960 MPa or less. If the yield strength of the cold-rolled steel sheet is less than 870 MPa, there may be a problem in that impact resistance of the parts deteriorates, and if the yield strength of the cold-rolled steel sheet exceeds 960 MPa, there may be a problem in that formability deteriorates.

In addition, according to an aspect of the present disclosure, the cold-rolled steel sheet has a product of tensile strength and elongation of 15,000 MPa % or more, more preferably 16,000 MPa % or more and 20,000 MPa % or less, and most preferably, 16,300 MPa % or more and 18,000 MPa % or less. By satisfying the above-described physical properties, it is possible to secure an effect that can be suitably applied to highly formed parts since both strength and formability are excellent.

Although not particularly limited thereto, the cold-rolled steel sheet may optionally further include a plating layer formed on the surface. In this case, the plating layer may be formed through a plating process to be described later. In addition, since the composition of the plating layer can be applied differently depending on the purpose thereof, it is not particularly limited in this specification, and an example of the plating layer may include a zinc-based plating layer.

Hereinafter, a method for manufacturing a high-strength cold-rolled steel sheet according to an aspect of the present disclosure will be described in detail. However, the method for manufacturing the cold-rolled steel sheet according to the present disclosure does not necessarily mean that it should be manufactured by the following manufacturing method.

Reheating a Steel Slab

A steel slab satisfying the above-described composition is reheated to a temperature within a range of 1100 to 1350° C. The composition of the steel slab is the same as that of the cold-rolled steel sheet described above, and in this case, the description for the above-described cold-rolled steel sheet is equally applied to a reason for adding each component and limiting a content thereof in the steel slab. Meanwhile, if a reheating temperature of the steel slab is less than 1100° C., segregated alloy elements in a center portion of the slab remain, and an initiation temperature of hot rolling is too low, causing a problem in increased rolling load. On the other hand, if the reheating temperature of the steel slab exceeds 1350° C., there is a problem in that strength is reduced due to coarsening of austenite grains. Therefore, in the present disclosure, the reheating temperature of the steel slab is preferably controlled to a temperature within a range of 1100 to 1350° C.

Hot Rolling

The reheated steel slab is hot rolled at a temperature of 850 to 1150° C. If a temperature of hot rolling exceeds 1150° C., a temperature of a hot-rolled steel sheet increases, so a size of grains becomes coarse, surface quality of the hot-rolled steel sheet deteriorates. If the temperature of hot rolling is less than 850° C., due to development of stretched grains due to excessive recrystallization delay, a load during rolling increases and a temperature in both end portions decreases significantly, so a non-uniform microstructure during cooling is formed, thereby increasing material deviation and deteriorating formability.

Cooling, After Hot Rolling

The hot-rolled steel sheet is cooled to a temperature within a range of 450 to 700° C. at an average cooling rate of 10 to 70° C./s (more preferably, 20 to 50° C./s). If a cooling temperature of the hot-rolled steel sheet is less than 450° C., there is a problem in that material deviation deteriorates, and if the cooling temperature exceeds 700° C., there is a problem in that not only does material deviation occur, but also internal oxidation of the hot-rolled steel sheet occurs, causing surface defects. In addition, if the average cooling rate is less than 10° C./s, there is a problem in that crystal grains of a matrix structure become coarse and a microstructure becomes non-uniform. In addition, if the average cooling rate exceeds 70° C./s, there is a problem in that bainite and martensite phases are easily to be formed, causing increased load during cold rolling.

Coiling

The cooled steel sheet is wound at a temperature within a range of 450 to 700° C. If the coiling temperature is less than 450° C. and the steel sheet is cooled and wound, bainite and martensite phases are formed unnecessarily in steel, resulting in non-uniform shapes and a significant increase in rolling load during cold rolling. If the coiling temperature exceeds 700° C. and the steel sheet is wound, austenite crystal grains become larger and a coarse pearlite phase is easily formed, resulting in forming non-uniform microstructure during annealing, resulting in a problem of poor formability of steel. In addition, hot-rolled oxides increase and are adsorbed on a roll during annealing, causing oxides to accumulate in the roll. If the steel sheet is rolled, there is a problem causing surface defects such as dent defects on a surface of the steel sheet due to friction between the steel sheet and the roll. In addition, when hot-rolled oxides remain on the steel sheet, plating quality and plating adhesion are deteriorated during plating of the steel sheet.

Typically, after the coiling, cooling proceeds rapidly in both end portions of the wound steel sheet (coil) in a width direction due to exposure to surrounding atmosphere, and cooling proceeds slowly in a center portion of the wound steel sheet in the width direction. As a result, cooling deviation occurs in the width direction of the steel sheet from the coiling operation, causing a difference in microstructure at each position of the wound steel sheet, ultimately resulting in material deviation for the hot-rolled steel sheet. In a hot-rolled steel sheet having such high material deviation, in a process of perform cold rolling, not only does the material deviation of the hot-rolled steel sheet be deteriorated, but surface defects having a form of grooves, which were not observed with a naked eye in the hot-rolled steel sheet be more deteriorated after performing cold rolling, resulting in a problem of significant surface defects occurring. In other words, the hot-rolled steel sheet having high material deviation not only has inferior shapes during cold rolling, but also causes material deviation in each position in a width direction in a final annealed material. Therefore, the present inventors conducted intensive research to solve the above-described problem, and as a result thereof, a manufacturing method thereof is devised to control the temperatures in both end portions and in the center portion, differently in the coiling operation.

Specifically, in the present disclosure, as a method for reducing material deviation of the steel sheet in a width direction, and suppressing surface defects, during the coiling, a surface temperature (Te) in both end portions in the width direction is controlled to satisfy 601 to 700° C., and a surface temperature (Tc) in a center portion is controlled to satisfy 450 to 600° C., based on a total width of the steel sheet. In this case, the 'width direction of the steel sheet' refers to a direction perpendicular to a transport direction of the steel sheet based on a surface of the steel sheet. In addition, the above-description is equally applied to the both end portions and the center portion.

In this case, if Te is less than 601° C., there is a problem in that material deviation is worsened due to overcooling in both end portions, and if Te exceeds 700° C., there is a problem in that material deviation and surface defects are worsened due to deterioration of the center portion. In addition, if Tc is less than 450° C., a difference in the temperatures between the center portion and both end portions increases, causing a problem in that the material deviation worsens, and if Tc exceeds 600° C., the temperature in the center portion is too high, causing a problem of material deviation.

As described above, in the above-described coiling operation, in order to differently control the surface temperatures in the both end portions and in the center portion of the steel sheet in the width direction, various methods can be applied, so this is not particularly limited. For example, in order to control the temperatures in the both end portions and in the center portion of the steel sheet differently during the coiling, in the cooling operation before coiling, an amount of coolant injected onto both end portions may be blocked before reaching the steel sheet, an amount of coolant injected thereonto may be controlled differently, or the two methods described above, may be used in parallel. As an example, according to an aspect of the present disclosure, in the cooling operation before the coiling, based on a total width of the steel sheet, an amount of coolant injected onto the center portion excluding the both end portions may be controlled to be greater than an amount of coolant injected onto both end portions in the width direction.

In addition, according to an aspect of the present disclosure, although not particularly limited thereto, in terms of further improving the effect of further reducing material deviation and suppressing surface defects, in the coiling operation, a difference (Te−Tc) between the surface temperature in the both end portions and the surface temperature in the center portion may be 150° C. or less. In this case, if the value of Te−Tc exceeds 150° C., a problem of worsening material deviation in the width direction may occur. However, the lower the temperature deviation calculated from Te−Tc, the more desirable it is, so a lower limit thereof may not be specifically limited, and may be preferably 0° C. Meanwhile, more preferably, the lower limit of the Te−Tc value may be 50° C., and an upper limit of the Te−Tc value may be 90° C.

Maintaining Within Heat Retaining Cover

After the above-described coiling operation, optionally, a steel sheet may be moved into a heat retaining cover and maintained at a temperature within a range of 400 to 500° C. for more than 6 hours. After the coiling operation, by maintaining the steel sheet in the heat retaining cover for a long period of time, if the steel sheet is maintained for a long period of time at a temperature in a range of 601 to 700° C. and 450 to 600° C. in both end portions and in a center portion of the steel sheet, respectively, a cold-rolled steel sheet having excellent shape quality because a large amount of bainite structure is formed uniformly in the both end portions and in the center portion due to an overall length of a coil, and having low rolling load and uniform thickness during cold rolling may be manufactured.

In the maintenance operation within the heat retaining cover, a surface temperature of the steel sheet may be adjusted to a temperature within a range of 450 to 500° C.

In this case, in the maintenance operation within the heat retaining cover, if the surface temperature of the steel sheet is less than 400° C., the above-described effect cannot be secured, and if the surface temperature of the steel sheet exceeds 500° C., coarse carbides are formed locally and hot-rolled oxides increase, which may deteriorate the formability and surface quality of steel.

In addition, if a holding time within the heat retaining cover is less than 6 hours, a problem of material deviation may occur. An upper limit of the holding time in the heat retaining cover is not particularly limited, but may be 8 hours or less as an example.

Additionally, in terms of further improving the above-described effect, the wound steel sheet can be stored in the heat retaining cover within 90 minutes, immediately after being wound, and if a time before being stored in the heat retaining cover exceeds 90 minutes, due to excessive air cooling, overcooling may occur in the center portion in the width direction, making it impossible to satisfy the temperature range of 450 to 600° C. Alternatively, after the maintenance operation within the heat retaining cover, air cooling or water cooling may be further performed to room temperature.

Cold-Rolling Operation

Cold rolling is performed on the wound steel sheet at a cold rolling reduction rate of 40 to 70%. If the cold rolling reduction rate is less than 40%, not only is it difficult to secure a target thickness but it is also difficult to correct a shape of the steel sheet. On the other hand, if the cold rolling reduction rate exceeds 70%, there is a high possibility of cracks occurring in an end portion of the steel sheet, and there is a problem of cold rolling load. Therefore, in the present disclosure, it is preferable to limit the cold rolling reduction rate to 40 to 70%.

Annealing Operation

The cold-rolled steel sheet is continuously annealed at a temperature of 740 to 900° C. If the annealing temperature is less than 740° C., non-recrystallization may occur, resulting in insufficient strength and elongation. If the annealing temperature exceeds 900° C., there may be a problem in that surface oxides occurs. Meanwhile, in terms of further improving the above-described effect, the annealing temperature may be more preferably 750 to 850° C.

In addition, although not particularly limited thereto, according to an aspect of the present disclosure, optionally, after the continuous annealing operation, optionally, an operation of primary cooling to a temperature of 650 to 700° C. at a cooling rate of 1 to 10° C./sec; and after the primary cooling operation, optionally, an operation of secondary cooling from Ms−100° C. to Ms+100° C. at a cooling rate of 11 to 20° C./sec. may be further included. In addition, after the secondary cooling operation, optionally, an operation of overaging the steel sheet while maintaining a temperature to be constant may be further included. By satisfying the conditions of the primary cooling operation, the secondary cooling operation, and the overaging operation, the strength and elongation may be further improved. In this case, Ms may mean a starting temperature at which martensite is generated when the steel sheet is cooled after annealing, and may be obtained from Relational Expression 2 below.

[Relational Expression 2]

$$Ms = 539 - 423 \times C - 30.4 \times Mn - 12.1 \times Cr - 17.7 \times Ni - 7.5 \times Mo$$

In Relational Expression 2, C, Mn, Cr, Ni, and Mo represent an average weight percentage for each element. In this case, when each of the above-described elements is not added, 0 is substituted.

In addition, according to an aspect of the present disclosure, optionally, an operation of plating (preferably, hot-dip galvanizing) the cold-rolled steel sheet may be further included, and a plated steel sheet can be obtained by performing the plating.

Mode for Invention

Hereinafter, the present disclosure will be specifically described through the following Examples. However, it should be noted that the following Examples are only for describing the present disclosure in detail by illustration, and are not intended to limit the right scope of the present disclosure. The reason is that the right scope of the present disclosure is determined by the matters described in the claims and reasonably inferred therefrom.

Example

A steel slab satisfying the composition in Table 1 below were reheated at a temperature of 1200° C., hot rolled at a temperature of 900° C., and cooled to a temperature within a range of 450 to 700° C. at a cooling rate of 20 to 50° C./s and then wound. In this case, during the coiling, based on a total width of a steel sheet in a width direction, an amount of coolant injected onto a center portion excluding the both end portions was controlled to be greater than an amount of coolant injected onto the both end portions in the width direction of the steel sheet so that a surface temperature (Te) of the steel sheet in both end portions of sections, corresponding to 30% from both ends and a surface temperature (Tc) in the center portion of remaining sections, corresponding to 40% from both ends satisfy the hot rolling conditions shown in Table 2 below. In addition, the wound hot-rolled steel sheet was moved into a heat retaining cover and as heat retaining cover conditions shown in Table 2 below, the wound hot-rolled steel sheet was controlled to satisfy an average temperature and holding time before and after being charged into a cover. Subsequently, the hot-rolled steel sheet was cold rolled at a cold rolling reduction rate of 50%, subjected to continuous annealing at a temperature of 840° C., primarily cooled to a temperature of 620° C. at an average cooling rate of 8° C./s, and then secondarily cooled to a temperature of Ms−70° C. at an average cooling rate 15° C./s, to obtain a cold-rolled steel sheet.

For each cold-rolled steel sheet obtained in this manner, a microstructure, mechanical properties, an average number of surface defects per unit area (number/$m^2$) observed on a surface of the steel sheet, in Inventive Example and Comparative Example, were measured and shown in Tables 3 to 5 below. In this case, YS, TS, and El mean 0.2% off-set yield strength, tensile strength, and elongation at break, respectively, which illustrates that test results obtained by collecting JIS No. 5 standard test samples from a center portion and both end portions, respectively, in a direction perpendicular to a rolling direction. In addition, the above-described microstructure was measured using a scanning electron microscope (FE-SEM), and the microstructure was measured using a photograph observed at 3,000 to 5,000 times magnification, by area. In addition, the average number of surface defects was measured by observing a surface of the manufactured steel sheet with a naked eye, and satisfying one or more conditions of a depth of 100 μm or more and a short side length of 1 mm or more. In particular, a maximum depth for the surface defects was measured in the same manner as described herein. In addition, for samples taken from the end portions and the center portion of the cold-rolled steel sheet in a width direction, the yield strength was measured in the same manner as described above, and the material deviation for these samples in the width direction was measured and shown in Tables 4 and 5 below.

TABLE 1

| Division | Composition [weight %] (Balance of Fe and impurities) | | | | | | | | | | Relational Expression |
|---|---|---|---|---|---|---|---|---|---|---|---|
| | C | Si | Mn | Cr | Mo | B | Al | P | S | N | 1 |
| Inventive Steel 1 | 0.18 | 1.6 | 2.58 | 0.42 | 0.02 | 0.0016 | 0.03 | 0.009 | 0.003 | 0.004 | 1.21 |
| Inventive Steel 2 | 0.195 | 1.7 | 2.68 | 0.65 | 0.2 | 0.0021 | 0.025 | 0.008 | 0.003 | 0.005 | 1.40 |
| Inventive Steel 3 | 0.19 | 1.9 | 2.72 | 0.7 | 0.15 | 0.0025 | 0.035 | 0.009 | 0.004 | 0.002 | 1.48 |
| Comparative Steel 1 | 0.26 | 2.3 | 2.75 | 0.53 | 0.25 | 0.0015 | 0.025 | 0.011 | 0.003 | 0.005 | 1.53 |
| Comparative Steel 2 | 0.16 | 0.8 | 2.6 | 0.75 | 0.11 | 0.002 | 0.025 | 0.012 | 0.003 | 0.005 | 1.14 |

TABLE 2

| Division | | Hot-rolling conditions | | | Heat retaining cover | |
|---|---|---|---|---|---|---|
| | | Te [°C] | Tc [°C] | Te − Tc [°C] | Temperature [°C] | Time [hour] |
| Inventive Steel 1 | Inventive Example 1 | 650 | 580 | 70 | 480 | 8 |
| | Inventive Example 2 | 680 | 590 | 90 | 450 | 7 |
| | Comparative Example 1 | 720 | 650 | 70 | 490 | 7 |
| | Comparative Example 2 | 580 | 400 | 180 | 420 | 8 |
| | Comparative Example 3 | 610 | 490 | 120 | Not applied | |
| | Comparative Example 4 | 650 | 590 | 60 | 570 | 10 |
| Inventive Steel 2 | Inventive Example 3 | 640 | 570 | 75 | 490 | 8 |
| | Inventive Example 4 | 680 | 590 | 90 | 450 | 7 |
| | Comparative Example 5 | 720 | 650 | 70 | 490 | 7 |
| | Comparative Example 6 | 580 | 400 | 180 | 420 | 8 |
| | Comparative Example 7 | 610 | 490 | 120 | Not applied | |
| | Comparative Example 8 | 650 | 590 | 60 | 570 | 10 |
| Inventive Steel 3 | Inventive Example 5 | 640 | 570 | 75 | 490 | 8 |
| | Inventive Example 6 | 680 | 590 | 90 | 450 | 7 |
| | Comparative Example 9 | 720 | 650 | 70 | 490 | 7 |
| | Comparative Example 10 | 580 | 400 | 180 | 420 | 8 |
| | Comparative Example 11 | 610 | 490 | 120 | Not applied | |
| | Comparative Example 12 | 650 | 590 | 60 | 570 | 10 |
| Comparative Steel 1 | Comparative Example 13 | 650 | 580 | 70 | 480 | 8 |
| | Comparative Example 14 | 680 | 590 | 90 | 450 | 7 |

TABLE 2-continued

| Division | | Hot-rolling conditions | | | Heat retaining cover | |
|---|---|---|---|---|---|---|
| | | Te [°C] | Tc [°C] | Te − Tc [°C] | Temperature [°C] | Time [hour] |
| Comparative Steel 2 | Comparative Example 15 | 720 | 650 | 70 | 480 | 8 |
| | Comparative Example 16 | 710 | 610 | 100 | 450 | 7 |

TABLE 3

| Division | | Microstructure [area %] | | |
|---|---|---|---|---|
| | | Austenite | Bainite | Martensite |
| Inventive Steel 1 | Inventive Example 1 | 4 | 78 | 18 |
| | Inventive Example 2 | 3 | 79 | 18 |
| | Comparative Example 1 | 4 | 76 | 20 |
| | Comparative Example 2 | 2 | 81 | 17 |
| | Comparative Example 3 | 3 | 85 | 12 |
| | Comparative Example 4 | 3 | 86 | 11 |
| Inventive Steel 2 | Inventive Example 3 | 4 | 82 | 14 |
| | Inventive Example 4 | 3 | 86 | 11 |
| | Comparative Example 5 | 2 | 78 | 20 |
| | Comparative Example 6 | 2 | 76 | 22 |
| | Comparative Example 7 | 3 | 82 | 15 |
| | Comparative Example 8 | 4 | 86 | 10 |
| Inventive Steel 3 | Inventive Example 5 | 4 | 84 | 12 |
| | Inventive Example 6 | 3 | 79 | 18 |
| | Comparative Example 9 | 4 | 85 | 11 |
| | Comparative Example 10 | 3 | 86 | 11 |
| | Comparative Example 11 | 3 | 90 | 7 |
| | Comparative Example 12 | 2 | 86 | 12 |

TABLE 3-continued

| Division | | Microstructure [area %] Austenite | Bainite | Martensite |
|---|---|---|---|---|
| Comparative Steel 1 | Comparative Example 13 | 5 | 43 | 52 |
| | Comparative Example 14 | 6 | 45 | 49 |
| Comparative Steel 2 | Comparative Example 15 | 13 | 56 | 31 |
| | Comparative Example 16 | 18 | 53 | 29 |

TABLE 4

| Division | | Material in center portion YS [MPa] | TS [MPa] | El [%] | TS*El [MPa %] | Surface defect [number/m$^2$] |
|---|---|---|---|---|---|---|
| Inventive Steel 1 | Inventive Example 1 | 921 | 1269 | 14 | 17766 | 1 |
| | Inventive Example 2 | 935 | 1257 | 14 | 17849 | 1 |
| | Comparative Example 1 | 892 | 1237 | 14 | 17194 | 14 |
| | Comparative Example 2 | 912 | 1278 | 14 | 17381 | 3 |
| | Comparative Example 3 | 899 | 1301 | 14 | 17564 | 2 |
| | Comparative Example 4 | 906 | 1284 | 13 | 16949 | 13 |
| Inventive Steel 2 | Inventive Example 3 | 925 | 1301 | 14 | 17954 | 0 |
| | Inventive Example 4 | 942 | 1299 | 13 | 17407 | 0 |
| | Comparative Example 5 | 917 | 1311 | 15 | 19010 | 12 |
| | Comparative Example 6 | 948 | 1299 | 13 | 17147 | 1 |
| | Comparative Example 7 | 962 | 1278 | 12 | 15464 | 2 |
| | Comparative Example 8 | 915 | 1307 | 12 | 15161 | 14 |
| Inventive Steel 3 | Inventive Example 5 | 888 | 1264 | 14 | 17064 | 1 |
| | Inventive Example 6 | 879 | 1245 | 13 | 16310 | 1 |
| | Comparative Example 9 | 902 | 1266 | 13 | 15825 | 13 |
| | Comparative Example 10 | 911 | 1255 | 13 | 15813 | 1 |
| | Comparative Example 11 | 895 | 1267 | 14 | 18118 | 1 |
| | Comparative Example 12 | 903 | 1279 | 12 | 15476 | 18 |
| Comparative Steel 1 | Comparative Example 13 | 1042 | 1530 | 9 | 13923 | 19 |
| | Comparative Example 14 | 1102 | 1511 | 10 | 14355 | 22 |
| Comparative Steel 2 | Comparative Example 15 | 721 | 1121 | 14 | 15918 | 1 |
| | Comparative Example 16 | 687 | 1052 | 15 | 15990 | 1 |

TABLE 5

| Division | | Material in both end portions YS [MPa] | YS deviation in width direction [MPa] |
|---|---|---|---|
| Inventive Steel 1 | Inventive Example 1 | 935 | 14 |
| | Inventive Example 2 | 958 | 23 |
| | Comparative Example 1 | 910 | 18 |
| | Comparative Example 2 | 1035 | 123 |
| | Comparative Example 3 | 1019 | 120 |
| | Comparative Example 4 | 953 | 47 |
| Inventive Steel 2 | Inventive Example 3 | 960 | 35 |
| | Inventive Example 4 | 943 | 1 |
| | Comparative Example 5 | 932 | 15 |
| | Comparative Example 6 | 1065 | 117 |
| | Comparative Example 7 | 1076 | 114 |
| | Comparative Example 8 | 935 | 20 |
| Inventive Steel 3 | Inventive Example 5 | 908 | 20 |
| | Inventive Example 6 | 908 | 29 |
| | Comparative Example 9 | 947 | 45 |
| | Comparative Example 10 | 1025 | 114 |
| | Comparative Example 11 | 1018 | 123 |
| | Comparative Example 12 | 986 | 83 |
| Comparative Steel 1 | Comparative Example 13 | 1130 | 88 |
| | Comparative Example 14 | 1135 | 33 |
| Comparative Steel 2 | Comparative Example 15 | 811 | 90 |
| | Comparative Example 16 | 757 | 70 |

As can be seen from the experimental results in Tables 1 to 5, in the case of Invention Examples 1 to 6 satisfying a composition and manufacturing conditions of the present disclosure, it was possible to obtain a cold-rolled steel sheet for securing a tensile strength (TS) of 1180 MPa or more, while suppressing material deviation and surface defects. In this case, it was confirmed that a maximum depth of the surface defects measured in the cold-rolled steel sheets obtained from Invention Examples 1 to 6 of the present application satisfied 500 μm or less.

On the other hand, in the case of Comparative Examples 1 to 16, not satisfying one or more of the composition and manufacturing conditions of the present disclosure, material deviation was inferior, surface defects occurred, and/or it was difficult to secure the physical properties desired in the present disclosure.

In particular, Comparative Steel 1 did not satisfy Relational Expression 1 due to an excessive amount of Si added. Therefore, in the case of Comparative Examples 13 and 14 using Comparative Steel 1, even though the manufacturing conditions set forth in the present disclosure were satisfied so the material deviation was good, a dent problem occurred due to Si oxide accumulation in an annealing furnace, so that there was a problem in that an average number of surface defects of a product exceeded a target value.

In addition, Comparative Steel 2 did not satisfy Relational Expression 1 due to a small amount of alloy added. Therefore, in the case of Comparative Examples 15 and 16 using Comparative Steel 2, even though the manufacturing conditions set forth in the present disclosure were satisfied and surface defects and material deviation were good, the tensile strength was less than 1180 MPa, and a product of the tensile strength and elongation was less than 16,000 MPa, which did not satisfy a target material.

In addition, Comparative Examples 1, 5, and 9 illustrate an example in which temperatures in both end portions and in a center portion in a width direction were higher than the temperature set forth in the present disclosure, and Comparative Examples 4, 8, and 12 illustrate an example in which a temperature of a heat retaining cover exceeded a reference temperature. Accordingly, in the Comparative Examples, hot-rolled oxides were excessively generated, and a large number of surface defects of the final steel sheet occurred due to the oxides.

In addition, Comparative Examples 2, 6, and 10, illustrate an example in which temperatures in both end portions and in a center portion in a width direction were lower than the temperature suggested in the present disclosure, and Comparative Examples 2, 6, and 10 illustrate an example in which a difference (Te−Tc) between a surface temperature in both end portions and a surface temperature in the center portion exceeded 150° C., and Comparative Examples 3, 7, and 11, illustrates an example in which a heat retaining cover was not applied. Accordingly, in the above Comparative Examples, a target material of an annealed steel sheet could be secured and the average number of surface defects was good, but there was a problem in that deviation of the yield strength of the annealed steel sheet in the width direction exceeded the target value of 100 MPa.

The invention claimed is:

1. A cold-rolled steel sheet comprising, by weight %: C: 0.05 to 0.3%, Si: 0.01 to 2.0%, Mn: 1.5 to 3.0%, Al: 0.01 to 0.1%, P: 0.001 to 0.015%, S: 0.001 to 0.01%, N: 0.001 to 0.01%, Cr: 1.0% or less including 0%, Mo: 0.2% or less including 0%, and B: 0.005% or less including 0%, with a remainder of Fe, and unavoidable impurities, wherein a value defined by Relational Expression 1 satisfies 1.2 or more and 1.5 or less;

as a microstructure, by area %: a sum of bainite and martensite: 96% to 97%, and a remainder of austenite: 3% to 4%; and wherein an average number of surface defects satisfying one or more conditions of a depth of 100 μm or more and a short side length of 1 mm or more is less than $10/m^2$, a tensile strength is 1180 MPa or more and a yield strength is 870 MPa or more;

$$C+(1.3\times Si+Mn)/6+(Cr+1.2\times Mo)/5+100\times B \text{[Relational Expression 1]:}$$

wherein in Relational Expression 1, C, Si, Mn, Cr, Mo, and B represent an average weight percentage for each element and, when each of the above-described elements is not added, 0 is substituted.

2. The cold-rolled steel sheet of claim 1, wherein the microstructure comprises, by area %, bainite: 78% to 86%.

3. The cold-rolled steel sheet of claim 1, wherein the microstructure comprises, by area %, martensite: 11% to 18%.

4. The cold-rolled steel sheet of claim 1, wherein a product of the tensile strength and elongation is 15,000 MPa % or more.

5. The cold-rolled steel sheet of claim 1, wherein a difference in yield strength between both end portions and a center portion in a width direction of the cold-rolled steel sheet is 100 MPa or less.

6. A method for manufacturing the cold-rolled steel sheet of claim 1, the method comprising:

reheating a steel slab including, by weight %, C: 0.05 to 0.3%, Si: 0.01 to 2.0%, Mn: 1.5 to 3.0%, Al: 0.01 to 0.1%, P: 0.001 to 0.015%, S: 0.001 to 0.01%, N: 0.001 to 0.01%, Cr: 1.0% or less including 0%, Mo: 0.2% or less including 0%, and B: 0.005% or less including 0%, with a remainder of Fe, and unavoidable impurities, wherein a value defined by Relational Expression 1 satisfies 1.2 or more and 1.5 or less, to a temperature within a range of 1100 to 1350° C. to obtain a reheated steel slab;

hot rolling the reheated steel slab at a temperature within a range of 850 to 1150° C. to obtain a hot-rolled steel sheet;

cooling the hot-rolled steel sheet to a temperature within a range of 450 to 700° C. at an average cooling rate of 10 to 70° C./s to obtain a cooled steel sheet;

coiling the cooled steel sheet at a temperature within a range of 450 to 700° C. to obtain a wound steel sheet;

cold rolling the wound steel sheet at a reduction rate of 40 to 70%; and continuously annealing at a temperature within a range of 740 to 900° C. after the cold rolling to obtain the cold-rolled steel sheet;

wherein in the coiling, based on an entire width of the steel sheet, a surface temperature (Te) of both end portions in a width direction is controlled to satisfy a temperature within a range of 601 to 700° C., and a surface temperature (Tc) of a center portion is controlled to satisfy a temperature within a range of 450 to 600° C.;

$$C+(1.3\times Si+Mn)/6+(Cr+1.2\times Mo)/5+100\times B \text{[Relational Expression 1]:}$$

wherein in Relational Expression 1, C, Si, Mn, Cr, Mo, and B represent an average weight percentage for each element and, when each of the above-described elements is not added, 0 is substituted.

7. The method of claim 6, further comprising:

after the coiling, moving the wound steel sheet into a heat retaining cover and maintaining at a temperature within a range of 400 to 500° C. for more than 6 hours.

8. The method of claim 6, wherein in the coiling, a difference (Te−Tc) between the surface temperature of both end portions and the surface temperature of the center portion is controlled to satisfy a temperature of 150° C. or less.

9. The method of claim 6, wherein in the cooling, based on the entire width of the steel sheet, an amount of coolant provided onto the center portion excluding the both end portions is controlled to be greater than an amount of provided onto the both end portions in a width direction.

* * * * *